United States Patent [19]

Komanduri et al.

[11] 4,226,055

[45] Oct. 7, 1980

[54] DRESSING AND CONDITIONING RESIN-BONDED DIAMOND GRINDING WHEEL

[75] Inventors: Rangachary Komanduri; William R. Reed, Jr., both of Schenectady, N.Y.

[73] Assignee: General Electric Company, Schenectady, N.Y.

[21] Appl. No.: 46,767

[22] Filed: Jun. 8, 1979

[51] Int. Cl.[3] ..... B24B 1/00

[52] U.S. Cl. ..... 51/325; 125/11 R; 125/11 CS

[58] Field of Search ..... 51/325, 262 T, 262 A; 125/11 R, 11 CD, 11 CS

[56] References Cited

U.S. PATENT DOCUMENTS

| | | | |
|---|---|---|---|
| 1,590,386 | 6/1926 | LaUellee | 51/262 T |
| 4,027,648 | 6/1977 | Bonnice | 125/11 R |
| 4,068,416 | 1/1978 | Bonnice | 125/325 |
| 4,182,082 | 1/1980 | Meyer | 125/11 R |

*Primary Examiner*—Harold D. Whitehead

*Attorney, Agent, or Firm*—Jane M. Binkowski; James C. Davis, Jr.; Leo I. MaLossi

[57] ABSTRACT

A method comprising contacting a wetting liquid with the surface of a resin-bonded diamond grinding wheel, wetting and forming a film on the face of the resin component of the wheel surface, and grinding and resulting wetted wheel surface with a silicon carbide or silicon nitride ceramic body generating ceramic chips which adhere to said wetted resin face forming a slurry layer thereon which simultaneously dresses and conditions said wheel during grinding.

4 Claims, 4 Drawing Figures

DRESSING AND CONDITIONING RESIN-BONDED DIAMOND GRINDING WHEEL

The present invention relates to the dressing and conditioning of a resin-bonded diamond grinding wheel.

A grinding wheel is trued by removing small amounts of material from the surface of a rotating wheel to maintain concentricity. Otherwise, due to unbalance, the wheel chatters at the high grinding speed and unsatisfactory performance results. Dressing is a much finer operation than truing, wherein the tips of the abrasives are subjected to delicate microcleavage fracture to provide sharp fracture facets to the grits which remove material efficiently in subsequent grinding by sharp cutting action of the grits.

In machine grinding operations, it is necessary to dress the face of the grinding wheel to assure the proper shape of the part to be ground (the workpiece) and to prepare or restore the surface of the grinding wheel to optimize its cutting ability and to insure that the quality of finish imparted to a workpiece is high.

Conventionally, resin-bonded diamond grinding wheels are trued and periodically dressed by a combination of techniques. Usually, truing is carried out with a silicon carbide brake composed of silicon carbide crystals embedded in a wheel, or by means of a truing tool containing diamond fines in a metal matrix. Dressing, on the other hand, frequently, is carried out by means of a fine grain size aluminium oxide abrasive dressing stick in a soft vitreous bond, either held by hand or clamped to the machine table. Alternatively, dressing is carried out by means of a rotary wire brush or by grinding on a soft steel work material. Different degrees of success have been reported using these techniques.

Briefly stated, the present method comprises contacting a resin-bonded diamond grinding wheel with a wetting liquid which wets the face of the resin component forming a film thereon and then grinding the wetted wheel with a polycrystalline silicon carbide or silicon nitride ceramic body generating chips or platelets of the ceramic which adhere to said wetted resin face forming a slurry thereon which simultaneously dresses and conditions said wheel during grinding of a workpiece.

The present method provides a number of advantages over the prior art. It provides sharp fracture facets of the diamond crystals on the surface of the grinding wheel, and also provides a mechanical shield on top of the resin bond thereby protecting it from thermal degradation and/or mechanical scouring, anchoring the diamond grits and reducing the costly grit pull out, thus improving the overall grinding wheel life. Diamond fines released from the wheel due to microcleavage fracture can get embedded into the silicon carbide or silicon nitride slurry and provide sharp cutting edges to the diamond grits on the surface of the grinding wheel by three-body abrasion. This ensures efficient cutting action. The net result is an improved wheel life and sharp cutting of the grinding wheel and good finish and accuracy of the ground part.

The invention may be more readily understood by reference to the accompanying figures in which.

Figure 3:
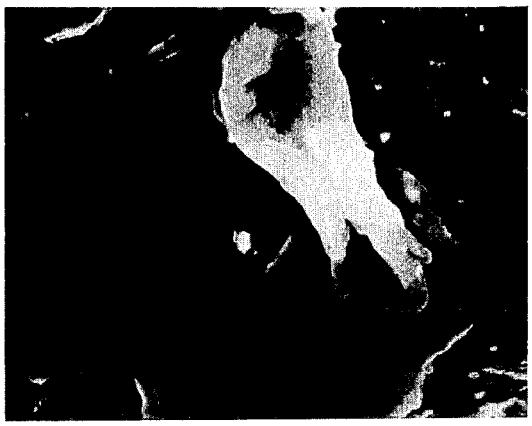
Figure 4:
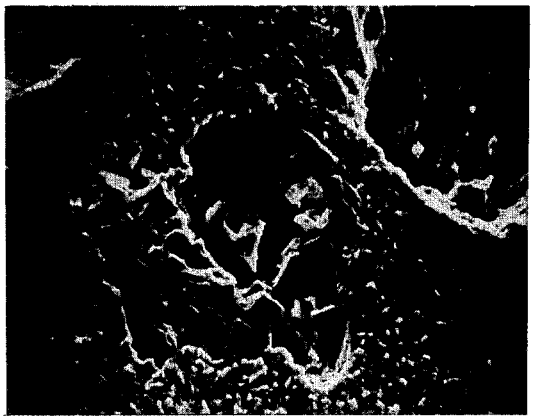

FIG. 3 is a photomicrograph (magnified 2000X) showing the present platelets or chips of silicon carbide being formed as the present polycrystalline silicon carbide body is ground with a resin-bonded diamond grinding wheel; and FIG. 4 is a photomicrograph (magnified 200X) showing the present dressing and conditioning layer comprised of chips or platelets of silicon carbide formed in FIG. 3 adhering to the film of wetting liquid forming a slurry therewith surrounding the diamond crystal of the wheel bond or grinding section.

Figure 1:
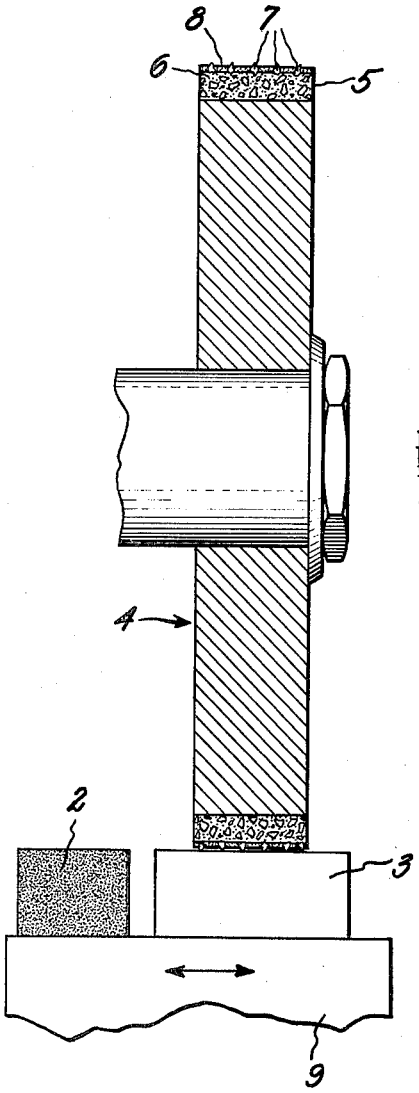
FIG. 1 is a schematic view in cross-section of one embodiment of the present invention showing the grinding of a workpiece by a resin-bonded diamond grinding wheel which also is carrying on the face of its resin bonding medium a thin slurry film composed of wetting liquid and chips of silicon carbide or silicon nitride.

Specifically, FIG. 1 shows polycrystalline silicon carbide or silicon nitride body 2 in juxtaposition to workpiece 3. Wheel 4 has a wheel bond or grinding section 5 comprised of resin 6 in which are embedded a plurality of diamond crystals 7. Means (not shown) are provided for maintaining a jet of wetting liquid against the surface of wheel bond or grinding section 5 sufficient to wet and form a film on the face of resin 6. Periodic grinding of the surface of wheel 4, i.e. grinding section 5, with silicon carbide or silicon nitride ceramic body 2 generates chips or platelets which adhere to the wet film on resin 6 forming a slurry therewith which is the present dressing and conditioning layer 8. Also, means (not shown) are provided for laterally moving wheel 4 for grinding with silicon carbide or silicon nitride body 2. Conventional means 9 is used for holding silicon carbide or silicon nitride body 2 and workpiece 3 in place during grinding by wheel 4.

Figure 2:
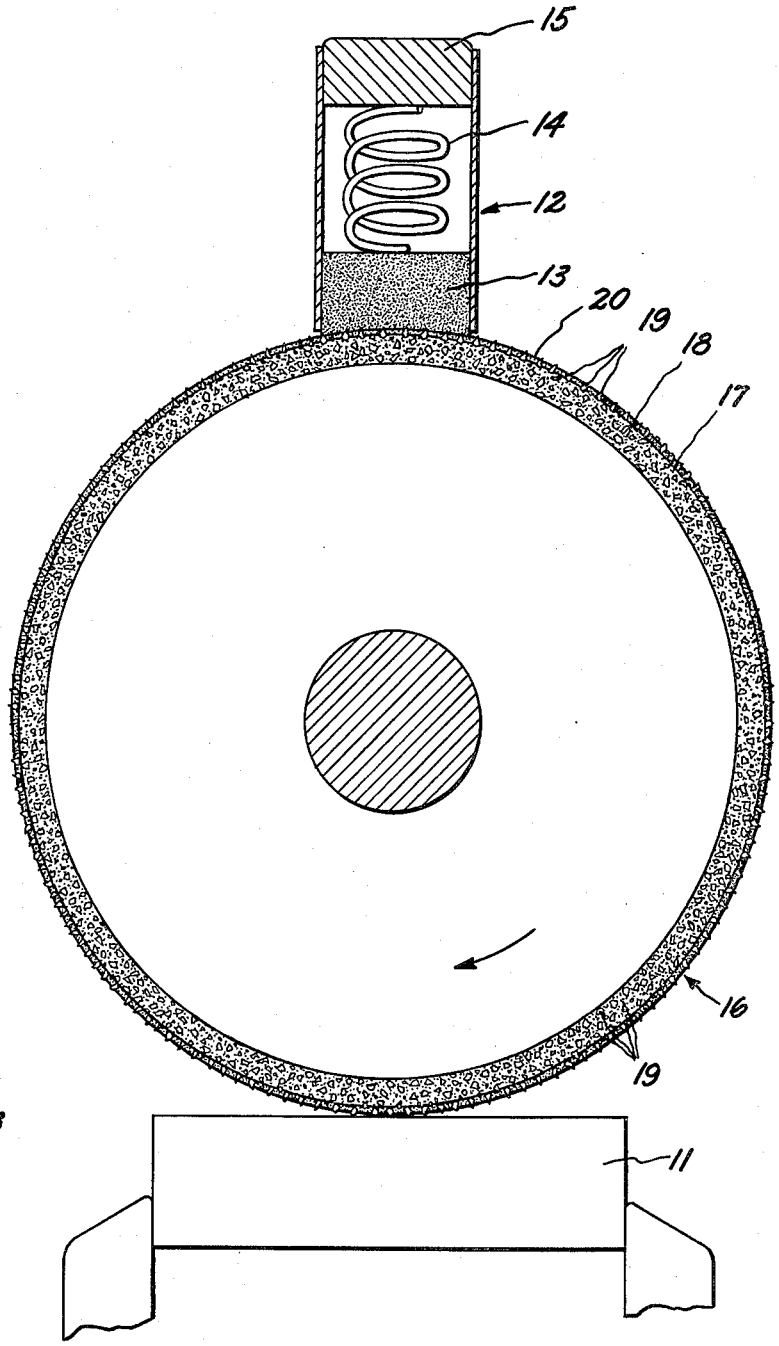
FIG. 2 is a schematic view of another embodiment of the present invention showing the grinding of a workpiece by a resin-bonded diamond grinding wheel and means for forming a slurry composed of wetting liquid and chips of silicon carbide or silicon nitride on the face of the resin bonding medium.

FIG. 2 shows a spring-loaded stick assembly 12 wherein silicon carbide or silicon nitride ceramic stick 13 is maintained by spring 14 under a load 15 to generate chips or platelets thereof when ground against wheel bond or grinding section 17. Wheel bond or grinding section 17 of resin bonded diamond grinding wheel 16 is comprised of resin 18 in which are embedded a plurality of diamond crystals 19. Means (not shown) are provided for maintaining a jet of wetting liquid against the face or surface of wheel bond 17 sufficient to form a film thereof on the face of resin 18. The present dressing and conditioning film 20 is formed on the wet face of resin 18 by grinding wheel bond 17 against silicon carbide or silicon nitride stick 13 for use on workpiece 11.

The polycrystalline silicon carbide ceramic body of the present invention is comprised of silicon carbide, i.e., it contains silicon carbide in an amount of at least about 90% by weight and usually at least about 95% by weight, and generally from 96% to about 99% or higher by weight, of the body. Any constituent or component of the present polycrystalline silicon carbide body other than silicon carbide should have no significant deteriorating effect on the properties of the silicon carbide or the face of the grinding wheel. The density of the silicon carbide body ranges from about 80% to about 100%. A silicon carbide body with a density lower than about 80% may not have sufficient mechanical strength which allows the generation of chips or platelets for the present process. Density given herein of the polycrystalline silicon carbide body is fractional density based on the theoretical density of silicon carbide of 3.21 gm/cc.

The present silicon carbide ceramic body can be prepared by processes such as hot pressing or sintering. For example, it can be prepared by hot-pressing silicon carbide powder, which can range in size from submicron to about 2000 microns, at high temperatures and pressures, for example, 1850° C. to 2300° C. and 5000 psi to 10,000 psi or higher. The resulting hot pressed body can have a density of about 80%. To achieve higher densities ranging up to about 100%, a densification additive such as boron or boron carbide must be included in the silicon carbide powder.

Specifically, the present polycrystalline silicon carbide bodies can be prepared by hot-pressing processes disclosed in U.S. Pat. Nos. 3,853,566; 3,960,577; 4,023,975 and 4,108,929; all assigned to the assignee hereof and all, by reference, are incorporated herein. In one hot-pressing process, a dispersion of submicron powder of silicon carbide and an amount of boron or boron carbide equivalent to 0.5–3.0% by weight of boron, is hot-pressed at 1900°–2000° C. under 5000–10,000 psi to produce a boron-containing silicon carbide body of high density.

The present silicon carbide ceramic body also can be prepared by sintering processes, i.e. sintering in a gaseous atmosphere. For example, U.S. Pat. No. 4,004,934 and 4,041,117 all assigned to the assignee hereof, and all by reference, are incorporated herein, disclose the production of suitable sintered polycrystalline silicon carbide bodies comprised of silicon carbide and based on the amount of silicon carbide, from about 0.3% to about 3% by weight of boron and up to about 1% by weight of free carbon.

The polycrystalline silicon nitride ceramic body of the present invention is comprised of silicon nitride, i.e., it contains silicon nitride in an amount of at least about 90% by weight and usually at least 95% by weight, and generally from 96% to about 99% or higher by weight, of the body. Any constituent or component of the present polycrystalline silicon nitride body other than silicon nitride should have no significant deteriorating effect on the properties of the silicon nitride or the face of the grinding wheel. The density of the silicon nitride body ranges from about 80% to about 100%. A silicon nitride body with a density lower than about 80% may not have sufficient mechanical strength which allows the generation of chips or platelets for the present process. Density given herein of the polycrystalline silicon nitride body is the fractional density based on the theoretical density of the silicon nitride of 3.18 gm/cc.

The present silicon nitride ceramic body, ranging in density from about 80% to about 100% of the theoretical density of silicon nitride, can be prepared by processes such as hot-pressing or sintering.

For example, it can be prepared by sintering processes disclosed in U.S. Pat. Nos. 4,119,689 and 4,119,690, both assigned to the assignee hereof, and both, by reference, are incorporated herein. Briefly stated, U.S. Pat. No. 4,119,689 discloses a sintered silicon nitride body prepared by shaping a powder dispersion of silicon nitride and a beryllium additive into a green body and sintering the green body from about 1900° C. to about 2200° C. in an atmosphere of nitrogen at a superatmospheric pressure which at the sintering temperatures prevents significant thermal decomposition of the silicon nitride. The process of U.S. Pat. No. 4,119,690 is similar to that of U.S. Pat. No. 4,119,689 except that a magnesium additive is also included.

The present hot-pressed polycrystalline silicon nitride ceramic body can be prepared by processes disclosed in U.S. Pat. Nos. 4,093,687 and 4,122,140, both assigned to the assignee hereof and both, by reference, are incorporated herein. Briefly, these processes comprise hot-pressing a powder dispersion of silicon nitride and magnesium silicide or a beryllium additive in an atmosphere of nitrogen from about 1600° C. to about 1850° C. under a minimum pressure of about 2000 psi.

The grinding wheel in the present invention is of the type having an effective grinding section, i.e. bond, comprised of a plurality of diamond crystals embedded in a resin bonding medium. The diamond crystals can be natural or synthetic.

Grinding wheels of this type commonly include a hub portion having a central bore therein adapting the hub portion to be mounted on a shaft or spindle. The hub portion is itself formed from some suitable support material commonly used in the art such as steel, bakelite or a light metal. Carried on the periphery of the hub portion in a position to make effective contact with a workpiece, is the effective grinding section. It is this section which includes the resin binding medium having diamond particles embedded therein.

Representative of the resin bonding mediums used in these wheels are thermo-setting bonding materials such as phenolaldehydes, epoxies, polyesters, modified phenolics, and the like. Also useful are resins known as essentially linear aromatic polymers such as aromatic polyimides, aromatic polyketones, polybenzimidazoles, and aromatic polyimines. Mixtures of resins may also be used according to known standard methods.

The present wetting liquid is a grinding fluid useful for cooling and lubricating the wheel face and should wet the face of the resin bonding medium sufficiently to form a film thereon. The present wetting liquid can be a grinding fluid conventionally used for resin-bonded diamond grinding wheels. Generally, the present wetting liquid is composed of water and a lubricating agent with its particular composition depending on the particular grinding operation, but frequently, it is composed of about 20–25 parts of water and 1 part of lubricating agent. The lubricating agent is usually a water-soluble oil such as, for example, an emulsifiable mineral oil.

During the grinding of the workpiece, the present slurry on the face of the resin bonding medium is replenished periodically, and the extent to which it must be replenished is determinable empirically, for example, it can be observed through a magnifying glass or a tool maker's microscope.

The platelets or chips of the present polycrystalline silicon carbide or silicon nitride ceramic body ordinarily have a thickness ranging from about 1 microns to about 500 microns, and preferably have a thickness of about 1 to about 100 microns. Their length can range from about 2 microns up to about 2500 microns and preferably from about 25 to 100 microns. Chips or platelets significantly larger than 500 microns in thickness and 2500 microns long would be too large to adhere to the thin film of wetting liquid on the face of the resin bonding medium.

The invention is further illustrated by the following examples wherein the procedure was as follows unless otherwise stated:

A resin-bonded diamond grinding wheel of $5\phi \times 3/16''$ wide with a $1\frac{1}{4}''$ bore was used. The wheel bond on the surface of the wheel had embedded therein nickel-coated diamond crystals having a grit size of 100/120 (CSG-II) which comprised 25% by volume of the bond. Since this was a new wheel, it was opened with a Norton brake device, i.e., a grinding wheel with a plurality of silicon carbide crystals embedded in a vitreous bond.

The wetting liquid was a chemical emulsion composed of 1 part of a soluble oil concentrate containing a stable Cl additive sold under the Trademark Trim-sol and 20 parts water.

The workpiece was a material comprised of 50% by volume tungsten carbide (44A WC)+50% by volume 1045 steel.

A hot-pressed polycrystalline silicon carbide ceramic body having a density of 3.15 g/cm$^3$ (98% relative density) and containing silicon carbide in an amount of at least about 95% by weight was used. It has a modulus of elasticity of 50 to $60\times10^6$ psi and a compressive strength of 150 to $250\times10^3$ psi.

A hot-pressed polycrystalline silicon nitride ceramic body having a density of 3.18 g/cm$^3$ (100% relative density) and containing silicon nitride in an amount of at least about 95% by weight of the body was used. It had a modulus of elasticity of $45\times10^6$ psi and a compressive strength of 100 to $120\times10^3$ psi.

The grinding ratio is defined as the ratio of the volume of material removed from the workpiece during a given grinding operation to the volume of material worn away from the grinding element during that grinding operation.

EXAMPLE 1

The conditions were as follows:
Wheel Speed—4500 sfpm
Table Speed—50 ft./min.
Cross feed—0.025 inch per pass
Down feed—0.0005 inch per pass The surface of the wheel was wetted continuously with the wetting liquid sufficiently to form at least a substantially continuous film thereof on the face of the resin bonding medium.

Six runs were carried out. For Runs A, B and C only the wetting liquid was used. For Runs D, E and F the wetting liquid was used and the wheel was automatically set to grind on the silicon carbide ceramic body periodically substantially as shown in FIG. 1. Grinding of the silicon carbide body produced platelets as shown in FIG. 3. These platelets were about 3 microns in thickness and had a length of about 40 microns. These silicon carbide platelets adhered to the film of wetting liquid on the face of the resin bonding medium forming a slurry therewith as shown in FIG. 4. The slurry was periodically replenished so that a thin film of slurry was substantially continuously maintained on the face of the resin bonding medium during runs D, E and F.

The results were as follows:
Run A Grinding Ratio—67
Run B Grinding Ratio—139
Run C Grinding Ratio—183
Run D Grinding Ratio—360
Run E Grinding Ratio—431
Run F Grinding Ratio—379

In each run the same amount of material was removed from the workpiece. In Run A, the grinding ratio may have been particularly low due to the wheel not being opened completely. Runs D, E and F, which illustrate the present invention, show a much higher grinding ratio than Runs A, B and C indicating that by the present process there is substantially less pull out of diamond crystals and less thermal degradation of the resin bond.

EXAMPLE 2

This example was carried out substantially as shown in FIG. 1, and in this example the polycrystalline silicon nitride ceramic body was used.

The conditions were as follows:
Wheel Speed—4500 sfpm
Table Speed—50 ft./min.
Cross Feed—0.025 inch per pass
Down Feed—0.0006 inch per pass The surface of the wheel was wetted continuously with the wetting liquid sufficiently to form at least a substantially continuous film thereof on the face of the resin bonding medium. Grinding of the silicon nitride body produced platelets of silicon nitride about 3 microns in thickness and about 40 microns in length. These silicon nitride platelets adhered to the film of wetting liquid on the face of the resin bonding medium forming a slurry therewith. The slurry was periodically replenished so that a thin film of slurry was substantially continuously maintained on the face of the resin bonding medium. The results were as follows:

Run G Grinding Ratio—347
Run H Grinding Ratio—361

The amount of material removed from the workpiece in Run G and Run H was the same as that removed in each of the runs in FIG. 1. The high grinding ratios of Runs G and H, as compared to Runs A, B and C of Example 1 where only wetting liquid was used, indicate substantially less diamond pull out and less thermal degradation of the resin bonding medium by the present process.

We claim:

1. A method for simultaneously dressing and conditioning a resin-bonded diamond grinding wheel during grinding which comprises contacting the surface of said resin-bonded diamond grinding wheel with a wetting liquid which wets the face of the resin component of said wheel surface forming a film thereon, grinding the wetted wheel with a polycrystalline ceramic body selected from the group consisting of silicon carbide which ranges in density from about 80% to about 100% of the density of silicon carbide and silicon nitride which ranges in density from about 80% to about 100% of the density of silicon nitride generating chips of said ceramic body which adhere to said wetted resin face forming a slurry layer thereon and grinding the resulting wheel with a workpiece.

2. A method according to claim 1 wherein said polycrystalline body is silicon carbide.

3. A method according to claim 1 wherein said polycrystalline body is silicon nitride.

4. A method according to claim 1 wherein said wetting liquid is composed of water and lubricating agent.

* * * * *